US007661163B1

(12) United States Patent
Gallaher

(10) Patent No.: US 7,661,163 B1
(45) Date of Patent: Feb. 16, 2010

(54) BODY LOUNGING SUPPORT CUSHION

(76) Inventor: Kami L. Gallaher, 616 Ocean Ave., Sea Bright, NJ (US) 07760

( * ) Notice: Subject to any disclaimer, the term of this patent is extended or adjusted under 35 U.S.C. 154(b) by 0 days.

(21) Appl. No.: 11/837,576

(22) Filed: Aug. 13, 2007

(51) Int. Cl.
*A47C 20/00* (2006.01)
*A47C 17/00* (2006.01)

(52) U.S. Cl. ..... 5/632; 5/638; 5/633; 5/734; 5/725

(58) Field of Classification Search ..... 5/638, 5/640, 722, 657, 725, 734, 632, 633
See application file for complete search history.

(56) References Cited

U.S. PATENT DOCUMENTS

| | | | | | |
|---|---|---|---|---|---|
| 1,548,728 | A | | 8/1925 | Milam | |
| 2,448,427 | A | * | 8/1948 | Gordon | 280/32.5 |
| 2,785,418 | A | | 3/1957 | Goguen | |
| 2,839,766 | A | | 6/1958 | Hull | |
| 3,009,172 | A | | 11/1961 | Eidam | |
| 3,140,497 | A | * | 7/1964 | Carswell | 5/638 |
| 3,162,486 | A | | 12/1964 | Emery | |
| 4,054,960 | A | | 10/1977 | Pettit et al. | |
| 4,275,472 | A | | 6/1981 | Erck | |
| 4,606,086 | A | | 8/1986 | Rowland | |
| 4,941,222 | A | | 7/1990 | Prager | |
| 4,987,625 | A | * | 1/1991 | Edelson | 5/657 |
| 5,014,375 | A | | 5/1991 | Coonrad et al. | |
| 5,509,153 | A | * | 4/1996 | Roschacher | 5/707 |
| 5,742,963 | A | * | 4/1998 | Trevino et al. | 5/632 |
| 6,427,272 | B1 | * | 8/2002 | Yacoub | 5/638 |
| 6,581,229 | B2 | * | 6/2003 | Bernstein | 5/722 |
| 6,588,034 | B2 | | 7/2003 | Nation | |
| 7,020,918 | B1 | * | 4/2006 | Tinsley | 5/632 |

* cited by examiner

*Primary Examiner*—Peter M Cuomo
*Assistant Examiner*—Jonathan J Liu
(74) *Attorney, Agent, or Firm*—Arthur Jacob

(57) ABSTRACT

A full-body support cushion supports a person essentially prone in either a face-up orientation or a face-down orientation, with the person's head, neck, upper torso, lower torso and legs maintained in comfortable longitudinal alignment. Upper body and lower body segments of fast-drying reticulated synthetic polymeric foam material include head and leg recesses for accommodating the person's head and legs when the person is relaxed in either orientation. An air passage provides an airway to the head recess. A pillow segment of similar foam material is coupled with the upper body segment for selective movement to close the head recess and prop up the person's head when desired for reading or other observations while in the face-up orientation.

14 Claims, 3 Drawing Sheets

BODY LOUNGING SUPPORT CUSHION

The present invention relates generally to lounging cushions and pertains, more specifically, to a full-body support cushion for supporting a person's body essentially prone in either a face-up orientation or a face-down orientation, with the person's head, neck, upper torso, lower torso and legs maintained in comfortable, relaxed and ergonomic alignment.

A very wide variety of lounges and lounge support cushions have been made available over the years, each proclaiming to provide comfort and support for a person's body. More recently, ergonomic considerations have captured the attention of purchasers seeking better support with increased comfort and safety. Unfortunately, the development of more ergonomically correct support structures has led to a concomitant increase in complexity and cost.

The present invention avoids the complexity and expense of currently available lounges and lounge support cushions while providing a desired ergonomically correct support. As such, the present invention attains several objects and advantages, some of which are summarized as follows: Provides a full-body support cushion for supporting a person's body essentially prone, in a comfortable, relaxed ergonomic position, in either a face-up or a face-down orientation; folds and unfolds for ready portability and easy set-up of an ergonomically correct support cushion placed either at ground level or on an elevated platform; enables a high degree of versatility in a relatively inexpensive construction capable of either indoor or outdoor use; provides increased comfort and safety together with enhanced ergonomic support, with convenience and economy; resists deterioration due to dampness, sunlight or other environmental conditions; encourages more widespread use of an ergonomically correct support utilizing a simplified, less expensive and more versatile support cushion; provides a support cushion capable of exemplary performance over an extended service life.

The above objects and advantages, as well as further objects and advantages, are attained by the present invention which may be described briefly as a full-body support cushion for supporting a person essentially prone in either a face-up orientation or a face-down orientation, with the person's head, neck, upper torso, lower torso and legs maintained in comfortable longitudinal alignment, the cushion comprising: an upper body segment having a length extending longitudinally between a head end and an upper torso end a width extending laterally between upper body segment side edges for supporting the upper torso and head, with the head adjacent the head end, the upper body segment including a head recess extending altitudinally into the upper body segment adjacent the head end, the head recess having a perimetric rim spaced from the head end for supporting the person's head when the head is received within the head recess to maintain the person's head, neck and upper torso essentially in longitudinal alignment; a lower body segment juxtaposed with the upper body segment, the lower body segment having a length extending longitudinally between a lower torso end juxtaposed with the upper torso end of the upper body segment, a foot end spaced longitudinally from the lower torso end, and a width between laterally spaced apart lower body segment side edges, the length of the lower body segment being substantially greater than the length of the upper body segment, the lower body segment including a pair of leg recesses extending longitudinally along and altitudinally into the lower body segment, the leg recesses being aligned essentially parallel to one another, spaced laterally from one another, spaced laterally from the lower body segment side edges, and spaced longitudinally from the lower torso end and from the foot end, each leg recess being aligned longitudinally for supporting the person's legs while the legs extend into respective leg recesses to maintain the person's legs in longitudinal alignment with the lower torso; a hinged joint interconnecting the upper body and lower body segments along confronting upper torso and lower torso ends for enabling selective folding of the upper body and lower body segments into and out of overlapping juxtaposition; a pillow segment adjacent the head end of the upper body segment, the pillow segment being dimensioned and configured for selectively closing the head recess; and a coupling arrangement coupling the pillow segment with the upper body segment for selective movement of the pillow segment between a first position wherein the pillow segment is remote from the head recess and a second position wherein the pillow segment is in overlapping juxtaposition with the head recess to close the head recess, whereby the person's head selectively will be propped altitudinally upon placement of the pillow segment in the second position.

The invention will be understood more fully, while still further objects and advantages will become apparent, in the following detailed description of a preferred embodiment of the invention illustrated in the accompanying drawing, in which.

Figure 1:
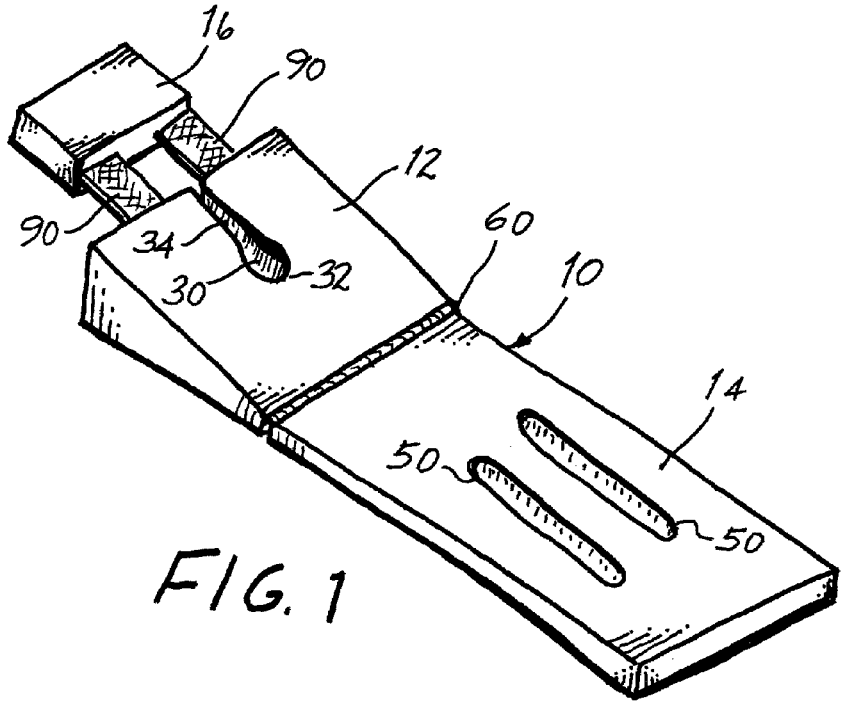
FIG. 1 is a pictorial perspective view of a full-body lounging support cushion constructed in accordance with the present invention.

Referring now to the drawing, and especially to FIGS. 1 through 4 thereof, a body lounging support cushion constructed in accordance with the present invention is shown at 10 and is seen to have an upper body segment 12, a lower body segment 14 and a pillow segment 16, all extending in a generally longitudinal direction, along a longitudinal axis 18. The upper body segment 12 has a length 20 extending longitudinally from a head end 22 to an upper torso end 24, and a width 26 extending laterally from one to the other of upper body segment side edges 28. A head recess 30 extends in an altitudinal direction into the upper body segment 12, preferably passing entirely through the upper body segment 12, as shown, adjacent the head end 22, and includes a perimetric rim 32. Head recess 30 is spaced longitudinally from the head end 22, and an air passage 34 extends from the recess 30 to the head end 22.

The lower body segment 14 is separate from the upper body segment 12 and includes a length 40 extending longitudinally from a lower torso end 42 to a foot end 44. A width 46 extends laterally from one to the other of lower body segment side edges 48. A pair of leg recesses 50 extend longitudinally, essentially parallel to one another and to side edges 48, the leg recesses 50 being spaced longitudinally from both the lower torso end 42 and the foot end 44, as well as being spaced laterally from one another and from the side edges 48. The leg recesses 50 extend altitudinally into lower body segment 14, and preferably pass entirely through the lower body segment 14.

In the preferred construction, lower body segment 14 has a thickness 52 which preferably remains essentially constant along the length 40. However, upper body segment 12 has a thickness 54 which preferably is increased from upper torso end 24, where thickness 54 is essentially the same as thickness 52, to head end 22, where thickness 54 is approximately twice thickness 52. In this manner, the upper surface 56 of upper body segment 12 is inclined relative to the upper surface 58 of the lower body segment 14, preferably in a linear fashion, for purposes to be described more fully below.

Figure 2:
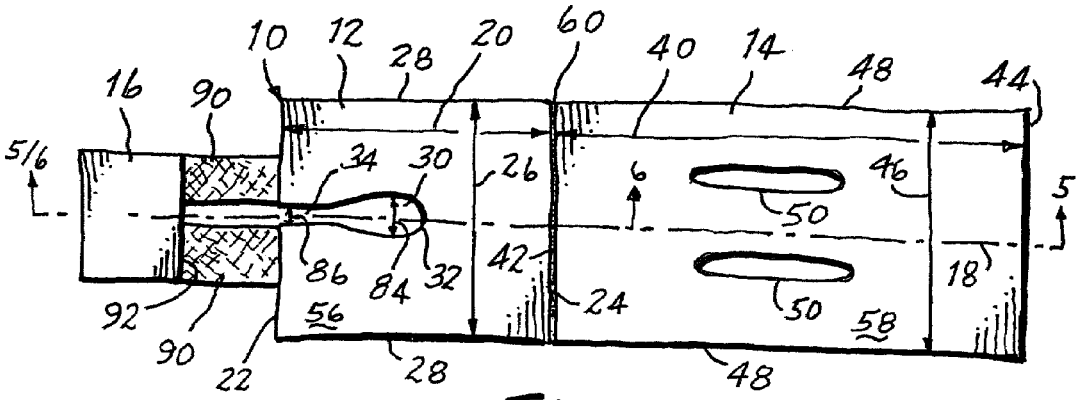
FIG. 2 is a top plan view of the cushion.
Figure 3:
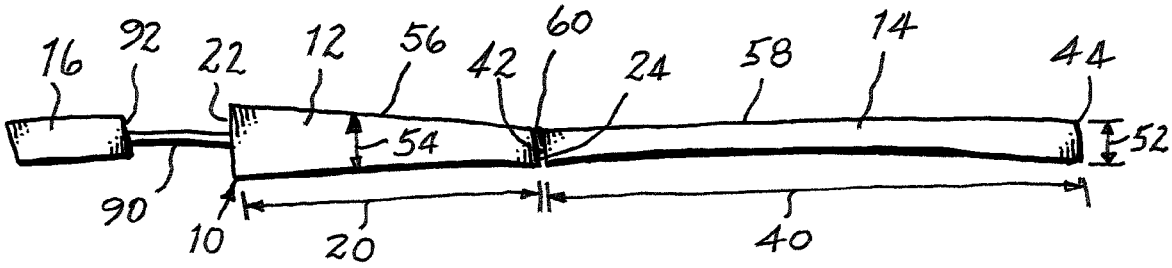
FIG. 3 is a side elevational view of the cushion.
Figure 4:
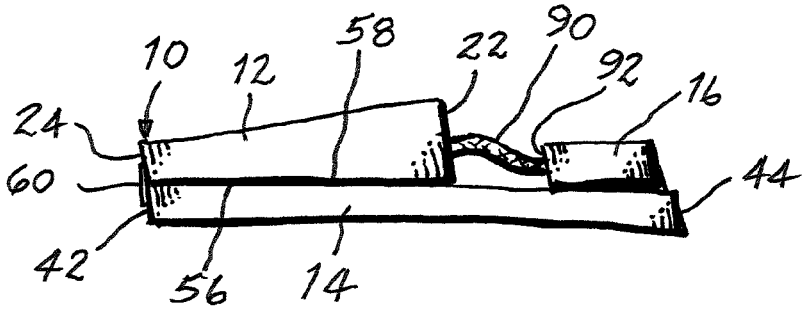
FIG. 4 is a side elevational view of the cushion in a compact folded configuration.

The upper body and lower body segments 12 and 14 are juxtaposed along confronting upper and lower torso ends 24 and 42 and are joined together at upper surfaces 56 and 58 with a hinged joint in the form of hinge 60. Hinge 60 preferably is constructed in the form of a strip of flexible fabric attached to both the upper body and lower body segments 12 and 14 so as to maintain the upper body and lower body segments 12 and 14 in appropriate longitudinal alignment when the upper body and lower body segments 12 and 14 are unfolded, as shown in FIGS. 1 through 3, while permitting selective folding of the upper body and lower body segments 12 and 14 into a compact configuration, as illustrated in FIG. 4, for ease of carrying. Thus, cushion 10 is readily portable when in the folded configuration illustrated in FIG. 4, wherein the upper body and lower body segments 12 and 14 are in altitudinally overlapped juxtaposition, and is easily set-up for use merely by unfolding segments 12 and 14 to establish the unfolded configuration shown in FIGS. 1 through 3.

Figure 5:
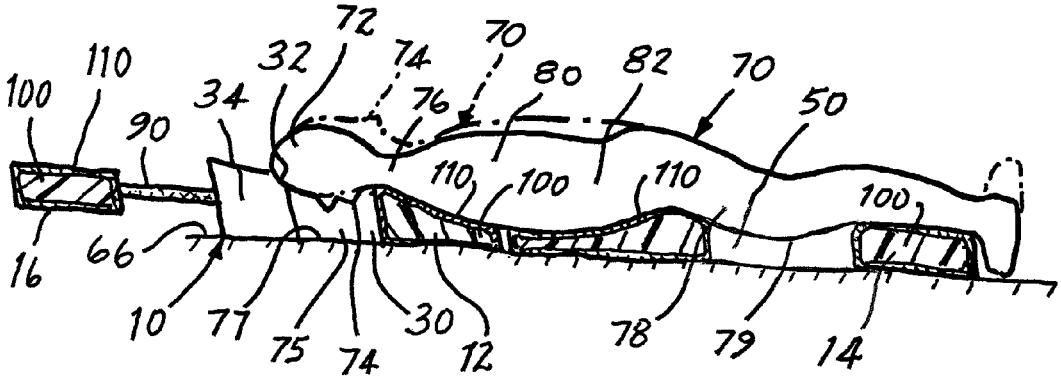
FIG. 5 is a longitudinal cross-sectional view taken along line 5-5 of FIG. 2.

Once cushion 10 is in the unfolded configuration, and with the cushion 10 placed either at ground level or upon an elevated platform, such as a lounge stand or other relatively rigid platform, as illustrated by solid platform 66 in FIG. 5, a person, shown at 70, can lie prone on the cushion 10. In a face-down orientation shown in full lines, the person's head 72 will rest upon the perimetric rim 32, with the person's face 74 entering the head recess 30 so that the person's neck 76 is maintained in appropriate ergonomic alignment along the upper body segment 12. Sufficient clearance is provided at 75 for the person's head 72 and face 74 by virtue of the thickness 54 of the upper body segment 12 and the altitudinal extent of the head recess 30. Should the cushion 10 be placed upon a solid platform which might close the head recess 30, as illustrated at 77 in FIG. 5, air passage 34 will provide an airway for the passage of air to the person 70. In the illustrated face-down orientation of person 70, the person's legs 78 will be aligned with the leg recesses 50 of the lower body segment 14, with the person's knees 79 placed within the leg recesses 50 so as to maintain an ergonomic alignment of the person's legs 78 along the cushion 10, whereby the person 70 will be comfortable and relaxed. Thicknesses 52 and 54 are great enough to assure that the person 70 remains elevated a sufficient distance from the solid platform 66 to maintain the desired ergonomic alignment, comfort and relaxation.

The relative lengths of the upper body and lower body segments 12 and 14 are such that the person's head 72, neck 76 and upper torso 80 are supported on the upper body segment 12, while the person's lower torso 82 and legs 78 are supported on the lower body segment 14. In the preferred construction of cushion 10, length 40 of the lower body segment is approximately 1.7 times the length 20 of the upper body segment 12. Typically, length 20 is about twenty-nine inches, while length 40 is about forty-nine inches. Head recess 30 has a width 84 of about four and one-half inches and is spaced longitudinally from upper torso end 24 by about fourteen inches, while air passage 34 has a width 86 of about two inches. Both widths 26 and 46 are about twenty-six inches, and the thickness 52 is about three and one-half inches. Leg recesses 50 are about two inches wide, have a length of about eighteen inches, are spaced apart from one another by about seven and one-half inches, and are space longitudinally about sixteen inches from lower torso end 42. Each leg recess 50 is spaced laterally from an adjacent lower body segment side edge 48 by about seven and one-quarter inches.

The upper body and lower body segments 12 and 14 are constructed of a resilient synthetic polymeric foam material so that when the person 70 is in the prone position, as shown, the person's contours will be accommodated for comfort and safety, in an ergonomically correct manner. The relief provided by the head recess 30 and the leg recesses 50, as well as the incline along the upper surface 56 of the upper body segment 12, assure that proper alignment is maintained for maximum relaxation and comfort. Should the person 70 desire to lie in a face-up orientation, as shown in phantom in FIG. 5, the head recess 30 and the leg recesses 50 will again accommodate the person's head 72 and legs 78 to maintain a comfortable, relaxed and ergonomically appropriate alignment of the person 70 on the cushion 10.

Figure 6:
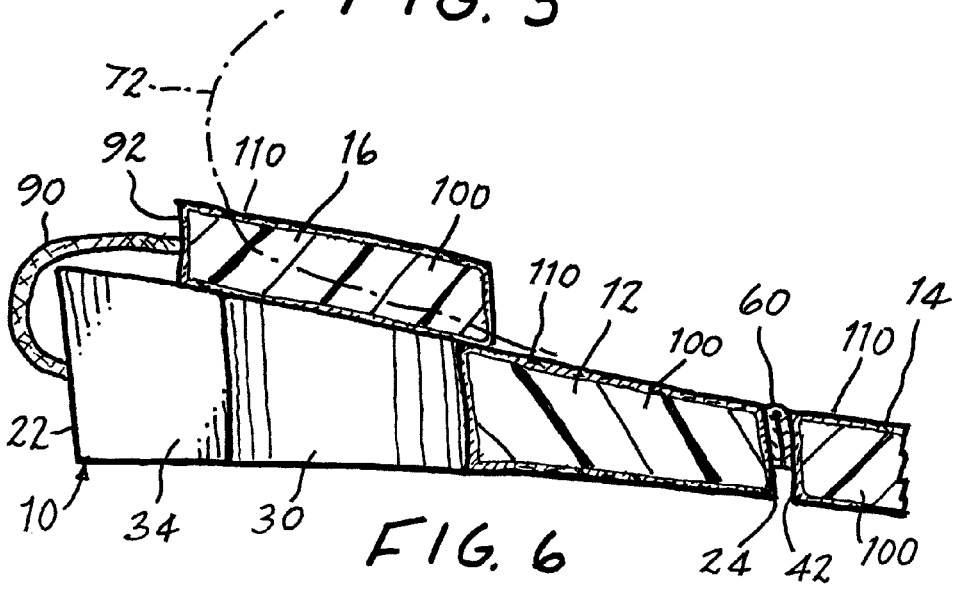
FIG. 6 is an enlarged fragmentary cross-sectional view taken along line 6-6 of FIG. 2, showing component parts in another position.

Should the person 70 desire to lie upon the cushion 10 in a face-up orientation with the person's head 72 propped up for reading or for observing the person's surroundings, pillow segment 16 is provided adjacent the head end 22 of the upper body segment 12. Pillow segment 16 is in the form of a pillow dimensioned, configured and located for enabling selective overlapping and closing of the head recess 30. A coupling arrangement couples the pillow segment 16 with the upper body segment 12 and includes a flexible web, shown in the form of a pair of flexible fabric straps 90, secured to the pillow segment 16 and to the head end 22 of the upper body segment 12. The pillow segment 16 includes a near end 92 confronting and spaced longitudinally from the head end 22, and the flexible straps 90 are shown secured at the near end 92 of the pillow segment 16 and at the head end 22 of the upper body segment 12. The straps 90 have a longitudinal length which enables selective movement of the pillow segment 16 between a first position, shown in FIGS. 1 through 5, wherein the pillow segment 16 is remote from the head recess 30, allowing reception of the person's head 72 in the head recess 30, and a second position, shown in FIG. 6, wherein the pillow segment 16 is flipped over and placed in overlapping juxtaposition with the head recess 30 to close the head recess 30 and allow the person's head 72 to be propped altitudinally, as shown in phantom, for reading or for observation purposes. Typically, the pillow segment 16 has a longitudinal length of about ten and one-half inches, a lateral width of about thirteen and one-half inches, and a thickness of about two and one-half inches, while the straps 90 each have a longitudinal length of about ten and one-half inches.

In the preferred construction of cushion 10, each of the segments 12, 14 and 16 is comprised of a pad 100 of fast-drying reticulated synthetic polymeric foam, such as a polyether-polyurethane foam made available commercially for use as an outdoor cushioning material. One source of such a material is Crest Foam Industries Incorporated, of Moonachie, N.J., the material being available under the trademark EZ-DRY. A cover 110 preferably envelops each pad 100 and is best constructed of an outdoor furniture fabric such as the fabric sold under the trademark SUNBRELLA, available from Glen Raven Custom Fabrics, LLC of Glen Raven, N.C.

It will be seen that the present invention attains all of the objects and advantages summarized above, namely: Provides a full-body support cushion for supporting a person's body essentially prone, in a comfortable, relaxed ergonomic position, in either a face-up or a face-down orientation; folds and unfolds for ready portability and easy set-up of an ergonomically correct support cushion placed either at ground level or on an elevated platform; enables a high degree of versatility in a relatively inexpensive construction capable of either indoor or outdoor use; provides increased comfort and safety together with enhanced ergonomic support, with convenience and economy; resists deterioration due to dampness, sunlight or other environmental conditions; encourages more widespread use of an ergonomically correct support utilizing a simplified, less expensive and more versatile support cushion; provides a support cushion capable of exemplary performance over an extended service life.

It is to be understood that the above detailed description of a preferred embodiment of the invention is provided by way of example only. Various details of design and construction may be modified without departing from the true spirit and scope of the invention, as set forth in the appended claims.

The invention claimed is:

1. A full-body support cushion for supporting a person essentially prone in either a face-up orientation or a face-down orientation, with the person's head, neck, upper torso, lower torso and legs maintained in comfortable longitudinal alignment, the cushion comprising:

an upper body segment having a length extending longitudinally between a head end and an upper torso end, a width extending laterally between upper body segment side edges for supporting the upper torso, neck and head, with the head adjacent the head end, the upper body segment including a head recess extending altitudinally downwardly entirely through the upper body segment adjacent the head end, the head recess having a perimetric rim spaced longitudinally from the head end for supporting the person's head when the head is received within the head recess to maintain the person's head, neck and upper torso supported essentially in longitudinal alignment;

an air passage extending from the head recess to the head end of the upper body segment; the air passage communicating with the head recess altitudinally below the perimetric rim for providing an airway for the passage of air to the person's head when the person's head is supported on the perimetric rim in the face-down orientation;

a lower body segment juxtaposed with the upper body segment, the lower body segment having a length extending longitudinally between a lower torso end juxtaposed with the upper torso end of the upper body segment, a foot end spaced longitudinally from the lower torso end, and a width between laterally spaced apart lower body segment side edges, the length of the lower body segment being substantially greater than the length of the upper body segment for supporting the lower torso and legs, the lower body segment including a pair of individual leg recesses extending longitudinally along and passing altitudinally entirely through the lower body segment, the leg recesses being aligned essentially parallel to one another, spaced laterally from one another, spaced laterally from the lower body segment side edges, and spaced longitudinally from the lower torso end and from the foot end, each leg recess being aligned longitudinally for supporting the person's legs while the legs extend into respective leg recesses to maintain the person's legs in longitudinal alignment with the lower torso;

a hinged joint interconnecting the upper body and lower body segments along confronting upper torso and lower torso ends for enabling selective folding of the upper body and lower body segments into and out of overlapping juxtaposition;

a pillow segment adjacent the head end of the upper body segment, the pillow segment being dimensioned and configured for selectively closed the head recess; and a coupling arrangement coupling the pillow segment with the upper body segment for selective movement of the pillow segment between a first position wherein the pillow segment is remote from the head recess and a second position wherein the pillow segment is in overlapping juxtaposition with the head recess to close the head recess, whereby the person's head selectively will be propped altitudinally above a closed head recess upon placement of the pillow segment in the second position.

2. The cushion of claim 1 wherein the length of the lower body segment is about 1.7 times the length of the upper body segment.

3. The cushion of claim 1 wherein the upper body and lower body segments each have a prescribed altitudinal thickness, the thickness of the lower body segment being essentially constant along the length of the lower body segment, the thickness of the upper body segment at the upper torso end being essentially the same as the thickness of the lower body segment, and increasing from the upper torso end to the head end such that the thickness of the upper body segment at the head end is greater than the thickness of the upper body segment at the upper torso end.

4. The cushion of claim 3 wherein the thickness of the upper body segment at the head end is approximately twice the thickness at the upper torso end.

5. The cushion of claim 3 wherein the thickness of the upper body segment increases linearly from the upper torso end toward the head end.

6. The cushion of claim 5 wherein the thickness of the upper body segment at the head end is approximately twice the thickness at the upper torso end.

7. The cushion of claim 1 wherein at least the upper body and lower body segments are comprised of a fast-drying reticulated synthetic polymeric foam material.

8. The cushion of claim 7 wherein at least the upper body and lower body segments each include a cover enveloping the synthetic polymeric foam material.

9. The cushion of claim 8 wherein the cover comprises an outdoor furniture fabric.

10. The cushion of claim 1 wherein the pillow segment is comprised of a fast-drying reticulated synthetic polymeric foam material.

11. The cushion of claim 10 wherein the pillow segment includes a further cover enveloping the synthetic polymeric foam material.

12. The cushion of claim 11 wherein the further cover comprises an outdoor furniture fabric.

13. The cushion of claim 1 wherein the coupling arrangement includes a flexible web interconnecting the pillow segment with the upper body segment.

14. The cushion of claim 13 wherein the pillow segment includes a near end confronting and spaced longitudinally from the head end of the upper body segment, and the flexible web extends between the near end of the pillow segment and the head end of the upper body segment, the web having a longitudinal length for enabling selective location and placement of the pillow segment in either one of the first and second positions.

* * * * *